US009916946B1

(12) United States Patent
Mathew et al.

(10) Patent No.: US 9,916,946 B1
(45) Date of Patent: Mar. 13, 2018

(54) FRAME HAVING A SINGLE ACTUATOR OPENING SHARED BY A TOGGLE ACTUATOR AND SLIDABLE DIMMER ACTUATOR

(71) Applicant: Leviton Manufacturing Co., Inc., Melville, NY (US)

(72) Inventors: Renjith Mathew, New Hyde Park, NY (US); Ronald Jansen, Ridgewood, NY (US); Adam Kevelos, Plainview, NY (US); Alfred Lombardi, Syosset, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 15/341,937

(22) Filed: Nov. 2, 2016

(51) Int. Cl.

| | |
|---|---|
| ***H01H 13/70*** | (2006.01) |
| ***H01H 15/02*** | (2006.01) |
| ***H01H 9/02*** | (2006.01) |
| ***H01H 9/18*** | (2006.01) |
| ***H01C 10/38*** | (2006.01) |

(52) U.S. Cl.
CPC ..... *H01H 15/02* (2013.01); *H01C 10/38* (2013.01); *H01H 9/0264* (2013.01); *H01H 9/181* (2013.01)

(58) Field of Classification Search
CPC ..... H01H 15/02; H01H 3/0213; H05B 39/00
USPC ..... 200/1 R, 4, 329, 330; 307/125
See application file for complete search history.

(56) References Cited

U.S. PATENT DOCUMENTS

| | | | |
|---|---|---|---|
| 3,986,022 | A | 10/1976 | Hyatt |
| 4,654,626 | A | 3/1987 | Carsello |
| 5,012,495 | A | 4/1991 | Munroe et al. |
| 5,262,678 | A | 11/1993 | Flowers et al. |
| 5,359,231 | A | 10/1994 | Flowers et al. |
| 5,637,930 | A | 6/1997 | Rowen et al. |
| 5,945,647 | A | 8/1999 | Hoskins |
| 6,005,308 | A | 12/1999 | Bryde et al. |
| 6,259,351 | B1 | 7/2001 | Radosavljevic et al. |
| 6,734,381 | B2 | 5/2004 | Mayo et al. |
| 7,170,018 | B2 | 1/2007 | Ilkhanov |
| 7,345,998 | B2 | 3/2008 | Cregg et al. |

(Continued)

OTHER PUBLICATIONS

Product Brochure for The Mural Collection, Leviton Manufacturing Co., Inc., Melville New York, 12 pages, 2000.

(Continued)

*Primary Examiner* — Vanessa Girardi
(74) *Attorney, Agent, or Firm* — Heslin Rothenberg Farley & Mesiti P.C.

(57) ABSTRACT

A dimmer switch includes a housing having a frame having a single actuator opening therethrough. The opening has first and second portions. A controllably conductive device is disposed in the housing for adjustably controlling electrical power to a load. A pivotable toggle actuator is accessible through the first portion of the single actuator opening and pivotable between a first and second positions by a user. A slidable dimmer actuator is accessible through the second portion of the single actuator opening. The slidable dimmer actuator is slidable linearly within the second portion of the single actuator opening anywhere between first and second positions by a user. The pivotable toggle actuator is operable for controlling the controllably conductive device to turn on and off power to the load, and the slidable dimmer actuator is operable for controlling the controllably conductive device to adjustably control the level of power to the load.

23 Claims, 10 Drawing Sheets

(56) References Cited

U.S. PATENT DOCUMENTS

| | | | |
|---|---|---|---|
| 7,400,239 | B2 | 7/2008 | Kiko et al. |
| D603,809 | S | 11/2009 | Mathew et al. |
| 7,663,325 | B2 | 2/2010 | McDonough et al. |
| 7,670,039 | B2 | 3/2010 | Altonen et al. |
| 7,777,145 | B2 | 8/2010 | Burrell et al. |
| 7,837,344 | B2 | 11/2010 | Altonen et al. |
| 7,985,937 | B2 | 7/2011 | Wu et al. |
| 8,003,904 | B2 | 8/2011 | Wu |
| 8,124,898 | B2 | 2/2012 | Mathew et al. |
| 8,138,435 | B2 | 3/2012 | Patel et al. |
| 8,173,920 | B2 | 5/2012 | Altonen et al. |
| 8,367,955 | B2 | 2/2013 | Strothmann |
| 8,459,812 | B2 | 6/2013 | Wu et al. |
| 8,536,473 | B2 | 9/2013 | Goyal et al. |
| 8,558,470 | B2 | 10/2013 | Shteynberg et al. |
| 8,624,142 | B2 | 1/2014 | Mathew et al. |
| 8,669,720 | B2 | 3/2014 | Goyal et al. |
| 8,717,718 | B2 | 5/2014 | Kamor et al. |
| 9,029,720 | B2 | 5/2015 | Strothmann |
| 9,329,607 | B2 | 5/2016 | Kevelos et al. |
| 9,767,973 | B2 | 9/2017 | Kevelos et al. |
| 2005/0099824 | A1 | 5/2005 | Dowling et al. |
| 2007/0193863 | A1 | 8/2007 | Wu |
| 2008/0151458 | A1 | 6/2008 | Beland et al. |
| 2009/0256483 | A1 | 10/2009 | Gehman et al. |
| 2010/0101924 | A1 | 4/2010 | Wu et al. |
| 2012/0257316 | A1 | 10/2012 | Kamor et al. |
| 2013/0162167 | A1 | 6/2013 | Gallo |
| 2013/0162168 | A1 | 6/2013 | Ostrovsky |
| 2014/0253483 | A1 | 9/2014 | Kupersztoch et al. |
| 2016/0041569 | A1 | 2/2016 | Kevelos et al. |
| 2016/0268074 | A1 | 9/2016 | Kevelos et al. |

OTHER PUBLICATIONS

Product Brochure for The Mural Collection II, Leviton Manufacturing Co., Inc., Melville New York, 7 pages, 2002.

Product Specifications, Inf. Cat.No. 6641-I, Leviton, 1 page, 2007.

Kevelos et al., pending U.S. Appl. No. 15/706,045, filed Sep. 15, 2017, entitled "Electrical Load Controller Having a Frame With an Integrally Formed Backlightable Indicator region" and Preliminary Amendment of Sep. 15, 2017.

Jansen et al., pending U.S. Appl. No. 15/790,745, filed Oct. 23, 2017, entitled "Actuator Alternating Indicator Light".

Jansen et al. U.S. Provisional Application entitled "Actuator Alternating Indicator Light", U.S. Appl. No. 62/416,597, filed Nov. 2, 2016, 35 pages.

FRAME HAVING A SINGLE ACTUATOR OPENING SHARED BY A TOGGLE ACTUATOR AND SLIDABLE DIMMER ACTUATOR

CROSS-REFERENCE TO RELATED APPLICATION

This application contains subject matter which is related to commonly owned and concurrently filed U.S. Patent Application Ser. No. 62/416,597, entitled "Actuator Alternating Indicator Light," by Ronald Jansen, Alfred Lombardi, and Adam Kevelos. The entire subject matter of this application being incorporated herein by reference.

FIELD OF THE DISCLOSURE

The present disclosure relates generally to dimmer switches, and more particularly, to dimmer switches and assemblies having a switch actuator for on/off control of a load and a dimmer actuator for adjusting the level of power delivered to the load.

BACKGROUND

Electrical wiring systems often include one or more electrical wiring devices such as dimmer switches that control power to one or more loads.

Prior art devices include a single actuator providing both a switch and a dimmer function. One example is a spring mounted thumbwheel actuator that acts as a dimmer when turned and that acts as a switch having an on-off function when pushed. Another example is a thumbwheel actuator or a slide actuator that has an on-off function at the beginning or end of the sliding or rotating action associated with the dimming function.

Prior art devices also include two side-by-side actuators, a switch actuator and a dimming actuator, that extend through separate/different openings. An example includes a toggle switch located in a first opening and operable for turning power on and off to the load and a dimmer actuator located in a second separate opening operable for controlling the amount of power to the load.

Prior art devices also include a side-by-side toggle switch and a rotatable dimmer wheel disposed in the same opening. The toggle switch is operable for turning power on and off to the load and the rotatable dimmer wheel is operable for controlling the amount of power to the load.

SUMMARY

Shortcomings of the prior art are overcome and additional advantages are provided through the provision, in one embodiment, of a dimmer switch for use in controlling electrical power to a load from an electrical power source. The dimmer switch includes, for example, a housing having a frame, the frame having a single actuator opening therethrough, the single actuator opening having first and second portions, and a controllably conductive device disposed in the housing for adjustably controlling electrical power to the load. A pivotable toggle actuator is accessible through the first portion of the single actuator opening. The toggle actuator is pivotable between a first position and a second position by a user. A slidable dimmer actuator is accessible through the second portion of the single actuator opening. The slidable dimmer actuator is slidable linearly within the second portion of the single actuator opening anywhere between a first position and a second position by a user. The pivotable toggle actuator is operable for controlling the controllably conductive device to turn on and off power to the load, and the slidable dimmer actuator is operable for controlling the controllably conductive device to adjustably control the level of power to the load.

In another embodiment, an assembly for use in controlling electrical power to a load from an electrical power source is provided. The assembly includes, for example, a frame having a single actuator opening therethrough, the single actuator opening having first and second portions, and a support operably attachable to the frame. A pivotable toggle actuator is accessible through the first portion of the single actuator opening. The toggle actuator is pivotable between a first position and a second position by a user. A slidable dimmer actuator is accessible through the second portion of the single actuator opening. The slidable dimmer actuator is slidable linearly within the second portion of the single actuator opening anywhere between a first position and a second position by a user. The pivotable toggle actuator is operable for controlling a controllably conductive device to turn on and off power to the load, and the slidable dimmer actuator is operable for controlling the controllably conductive device to adjustably control the level of power to the load.

Additional features and advantages are realized through the techniques of the present disclosure. Embodiments of the present disclosure are described in detail herein and are considered a part of the claims.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

Embodiments of the present disclosure and certain features, advantages, and details thereof, are explained more fully below with reference to the non-limiting examples illustrated in the accompanying drawings. Descriptions of well-known materials, processing techniques, etc., are omitted so as not to unnecessarily obscure the disclosure in detail. It should be understood, however, that the detailed description and the specific examples, while indicating embodiments of the present disclosure, are given by way of illustration only, and not by way of limitation. Various substitutions, modifications, additions, and/or arrangements, within the spirit and/or scope of the underlying inventive concepts will be apparent to those skilled in the art from this disclosure.

Figure 1:
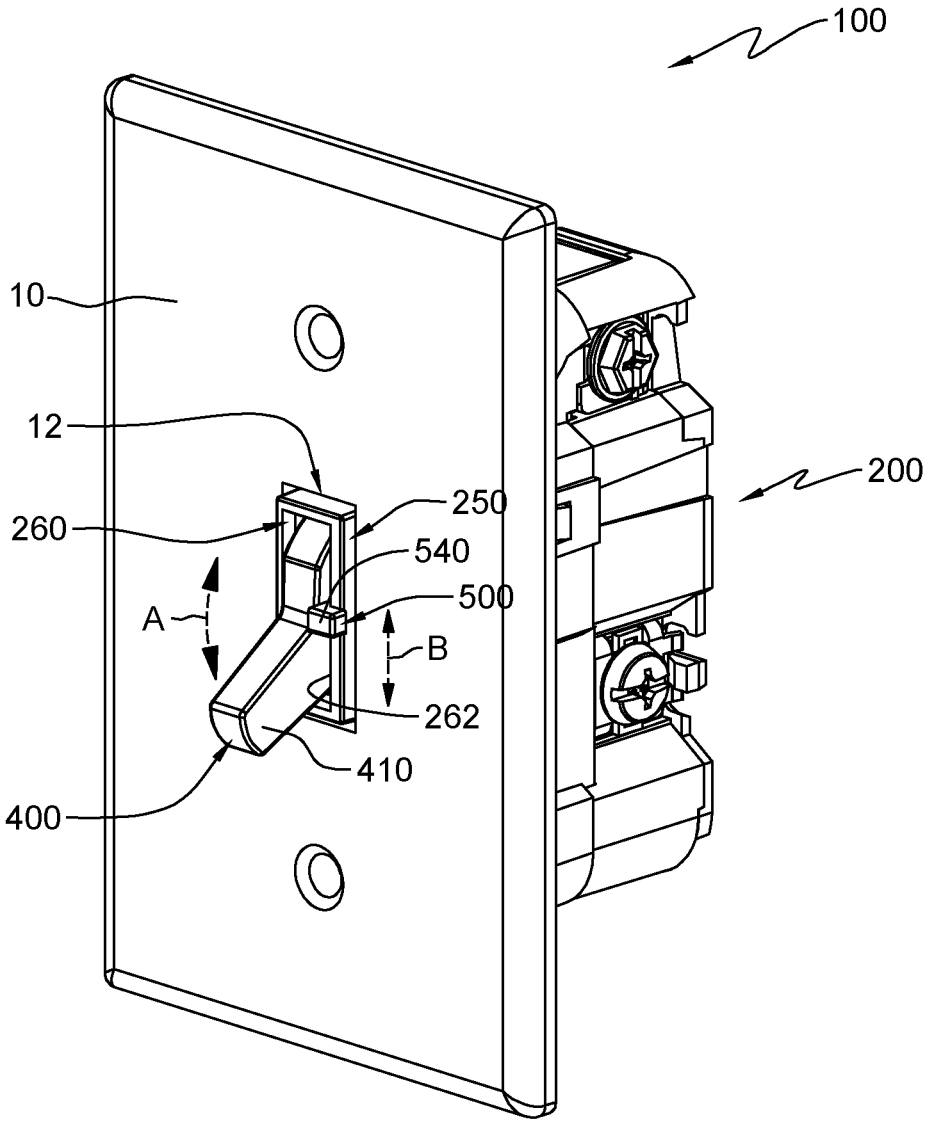
FIG. 1 is a perspective view of a dimmer switch according to an embodiment of the present disclosure along with a wall switch plate.
Figure 2:
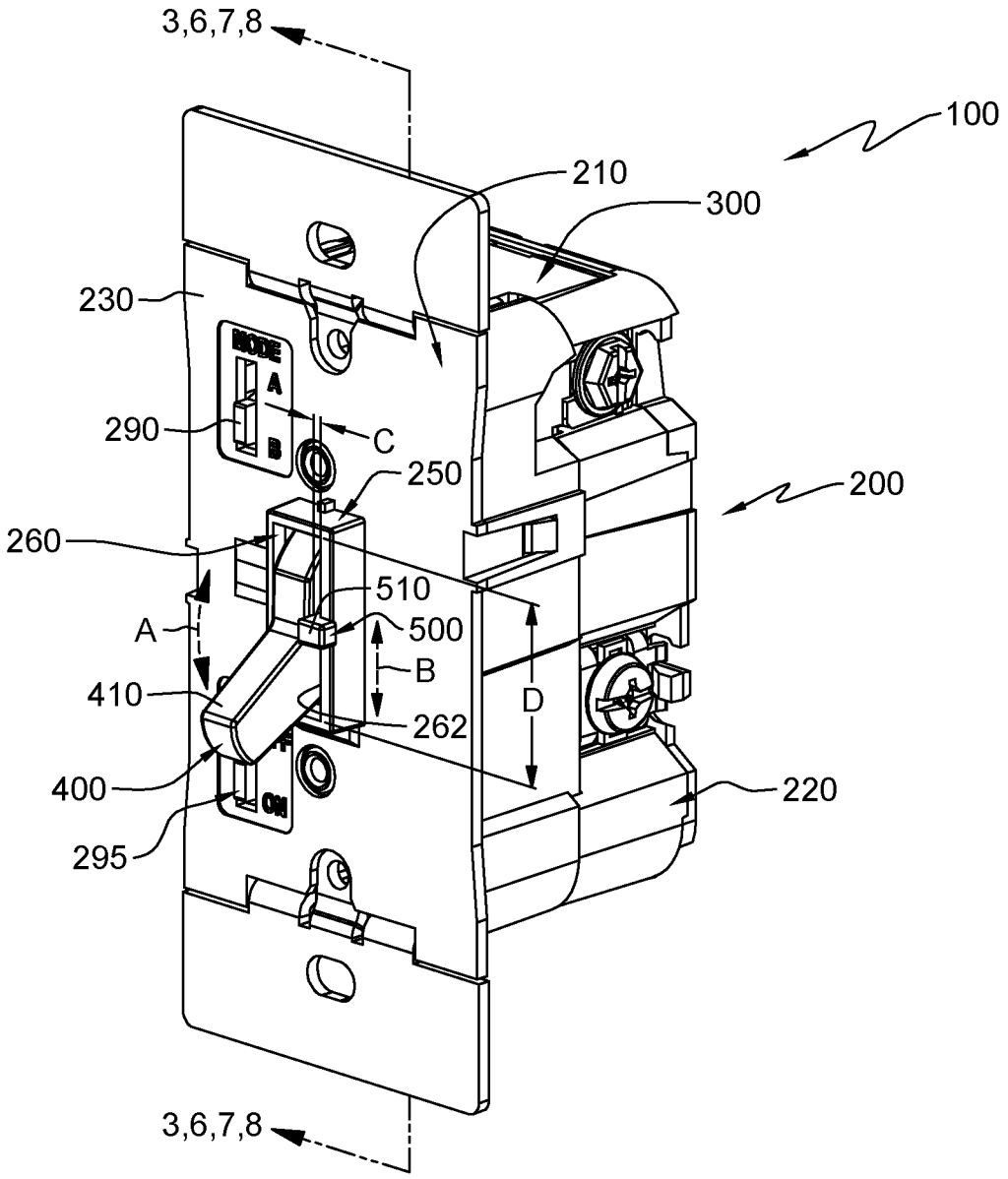
FIG. 2 is a perspective view of the dimmer switch of FIG. 1 without the wall switch plate.

FIGS. 1 and 2 illustrate a toggle dimmer switch 100 according to an embodiment the present disclosure for use in controlling electrical power to a load (not shown) from an electrical power source (not shown). Dimmer switch 100 may be mounted or installed in an electrical wall or junction box (not shown) such as on/in a wall of a room (not shown), and electrically coupled to at least one electrical load such as but not limited to a lighting fixture or a ceiling fan, which may be positioned in the same or a separate room remote from dimmer switch 100. Installed dimmer switch 100 may be covered by a wall switch plate 10 (FIG. 1).

Dimmer switch 100 may generally include a housing 200 having a frame 250 receivable in an opening 12 (FIG. 1) of wall switch plate 10 (FIG. 1). Frame 250 includes a passageway 260 therethrough defining a single actuator opening 262 through which extends separate and independent user accessible actuators for switching on/off and adjusting the level of electrical power to the load. Frame 250 may be a continuous frame, e.g. without having a break or interruption.

Dimmer switch 100 may include a main actuator, e.g., or pivotable toggle actuator 400, and a slidable dimmer actuator 500. Pivotable toggle actuator 400 and slidable dimmer actuator 500 include first, user accessible portions that extend outward from wall switch plate 10 (FIG. 1) for actuating control functions of the dimmer switch, and second portions that extend into housing 200 that interact with the other components of the dimmer switch 100 that perform the control functions. For example, pivotable toggle actuator 400 may include a lever 410 extendable through passageway 260 and out single actuator opening 262 in frame 250 and movable or pivotable in the direction of double headed arrow A within a first portion (e.g., a left side) of single actuator opening 262 between a first position (e.g., a lowered position as shown in FIG. 1) and a second position (e.g., an upper position not shown in FIG. 1) by a user for use in turning off and on electrical power to the load. Slidable dimmer actuator 500 may include a handle/slider 540 extendable through passageway 260 and out single actuator opening 262 in frame 250 and linearly slidable in the direction of double headed arrow B within a second portion (e.g., a right side) of single actuator opening 262 at any position between a first top position (e.g., above a position shown in FIG. 1) and a second bottom position (e.g., below the position shown in FIG. 1) by a user for use in adjustably controlling in graduated or incremental fashion the level of power to the load. A distance D (FIG. 2) between the first position and the second position of the pivotable toggle actuators may be the same or equal to the distance between the first top position and the second bottom position of the slidable dimmer actuator.

From the present description, it will be appreciated that dimmer switch 100 may include pivotable toggle actuator 400 and slidable dimmer actuator 500 disposed adjacent to each other, or side-by-side, in single actuator opening 262 in frame 250. Such a configuration may provide no intervening structure, material, or partitioning between adjacent portions of pivotable toggle actuator 400 and slidable dimmer actuator 500 that is visible to the user, for example, when the dimmer switch is installed on a wall. Such a dimmer switch may provide a less cluttered and more visually appealing dimmer switch compared to, for example, a conventional dimmer switch having separate openings having a partition therebetween in which a pivotable toggle actuator and a dimmer actuator are separately receivable therein.

The pivotable toggle actuator and the slidable dimmer actuator may generally have any suitable shape, contour, dimensions, angles, etc. for functional and/or aesthetic reasons. The frame, the pivotable toggle actuator, and the slidable dimmer actuator may be made of a non-conductive material, such as but not limited to, plastic or other well-known types of electrically non-conductive material. Alternatively, the user accessible surfaces of the dimmer switch, once installed, need not be non-conductive as long as the user accessible surfaces are electrically isolated from, for example, a building's electrical system. In addition, the dimmer switch or control as used here is not limited to operating a lighting device or fan, but may be used for controlling a variety of electrical devices by providing a variable level of power to the electrical device in a graduated or incremental fashion. For example, the dimmer switch or control may control a characteristic of an appliance, such as the volume of a radio or television.

Figure 3:
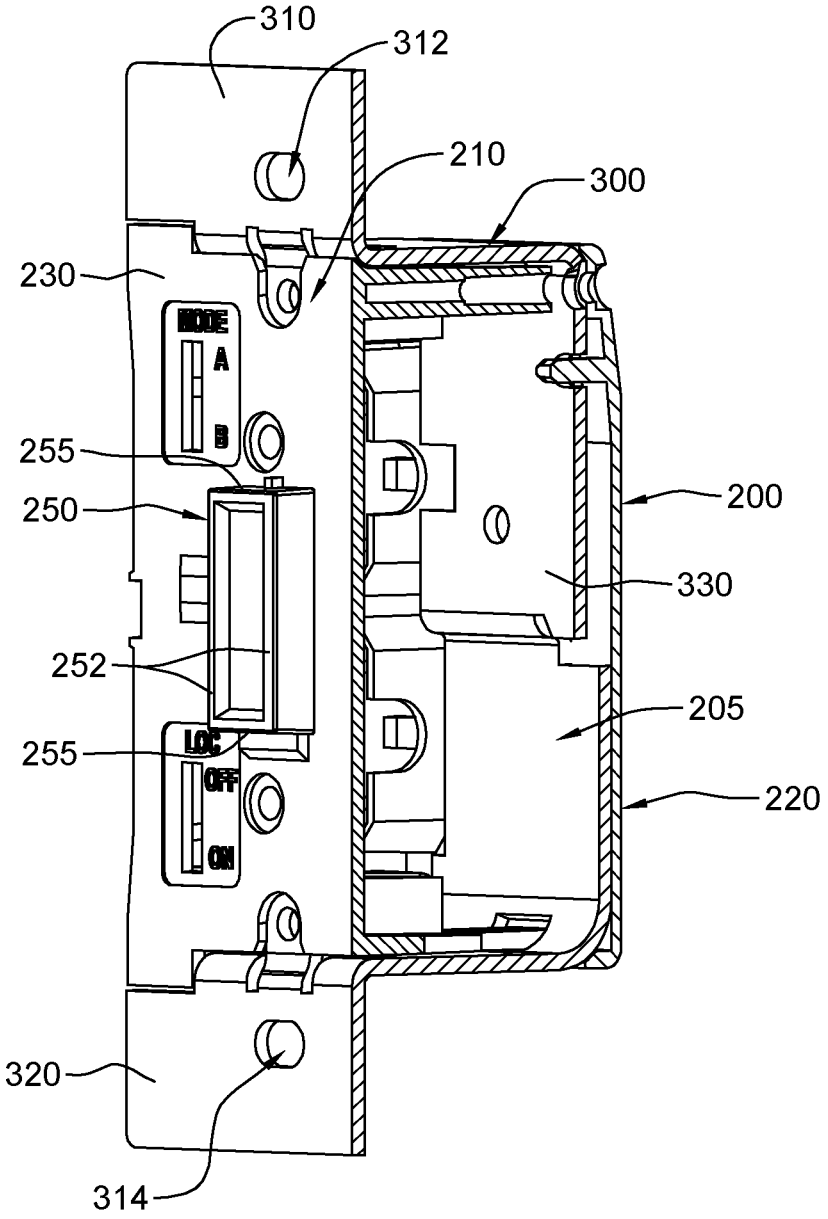
FIG. 3 is a perspective cross-sectional view taken along line 3-3 of the housing and the mounting strap of the dimmer switch of FIG. 2.

As shown in FIGS. 2 and 3, housing 200 may include a front housing portion 210 and a rear housing portion 220, which define a cavity 205 (FIG. 3) therein. Front housing portion 210 and rear housing portion 220 may be made of a nonconductive material, such as plastic and are attached to one another, such as by a fastener, e.g., a screw or mating structures for a snap fit. Front housing portion 210 may define a front plate 230 having frame 250 extending therefrom. As shown in FIG. 3, frame 250 may be defined by two sidewalls 252 and two end wall 255, which extend outward from front plate 230.

With reference still to FIG. 3, a U-shaped mounting strap 300 includes a first front portion 310, a second front portion 320, and a middle portion 330 disposed therebetween. Middle portion 330 of mounting strap 300 may be disposed along the inside of rear housing portion 220. Front portions 310 and 320 maybe aligned with front plate 230 of housing 200. Mounting strap 300 may include openings 312 and 314 in front portions 310 and 320 to mount dimmer switch 100 to an electrical junction box. Front housing portion 210, rear housing portion 220, and mounting strap 300 may be operably connected together, e.g. front housing portion 210 and rear housing portion 220 maybe fastened together and mounting strap 300 sandwiched or trapped in between. Mounting strap 300 may be sized to be mounted to an electrical junction box and be covered by a wall plate. U-shaped mounting strap may allow for access from the front of dimmer switch 100 during manufacture before front housing portion 210 is secured in position.

With reference again to FIG. 2, dimmer switch 100 may include electrical wiring terminals or screws (two of which are shown in FIG. 2) such as a line terminal, a neutral terminal, a load terminal, a ground terminal, to secure electrical conductors to the wiring device. Mounting strap 300 can be made of a thermally/electrically non-conductive or conductive material and in the case of a conductive material, e.g., aluminum, may include a ground terminal (not shown) for connection to a ground conductor of an electrical wiring system or a thermal connection to a heat source of the dimmer. The U-shaped mounting strap may be formed of a thermally and electrically conductive material, such as metal, e.g., aluminum, and conducts heat and electricity. It will be appreciated that other housing configurations having a frame with a single actuator opening may be suitably employed. In other embodiments, the frame may not be an integral part of the housing but may be a separate part such as a part of an actuator assembly, which actuator assembly may operably attach to or be supported by a housing.

Figure 4:
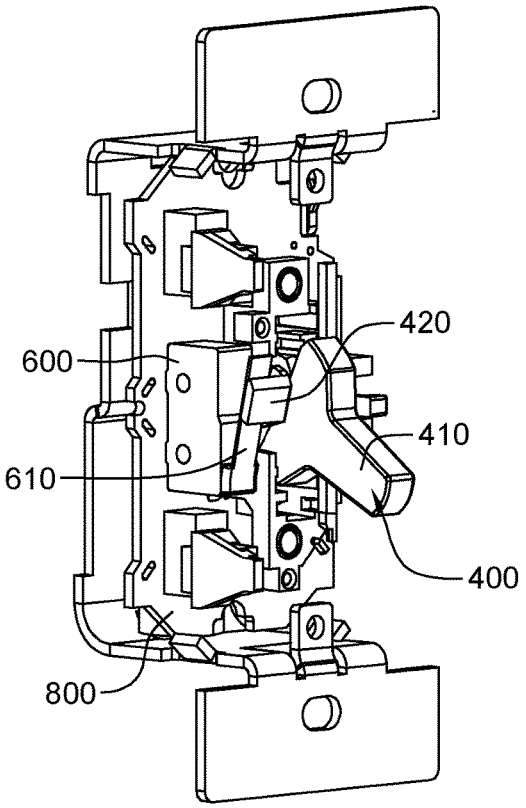
FIGS. 4 and 5 are perspective views of the dimmer switch of FIG. 1 without the housing.

As shown in FIG. 4, pivotable toggle actuator 400 is operable to engage an electronic device 600 disposed in the housing for turning electrical power on and off to the load. For example, pivotable toggle actuator 400 may include a leg 420 that acts as a lever which moves up and down as lever 410 is moved between positions. In the present example, controllably conductive device 600 may be a switching device that opens and breaks a circuit such as a snap action microswitch. When lever 410 is in an up position (as shown in FIG. 4), lever 410 causes a break in the circuitry of controllably conductive device 600 so that power is not provided to the load. When lever 410 is disposed in a down position (not shown in FIG. 4), lever 410 moves a lever 610 of controllably conductive device 600 that causes power to flow through circuitry of the dimmer switch 100 so that power is provided to the load. In other embodiments, a dimmer switch may be operably connected for 3-way applications. For example, in a 3-way application, the circuit may be broken when the toggle is in the up position and circuit is made when the toggle is in the down position. With reference again to FIG. 2, dimmer switch 100 may include a mode switch 290 operable to allow a user to select a mode A for operation of dimmer switch 100 in controlling incandescent bulbs and LEDs, and operable to allow a user to select a mode B for operation of dimmer switch 100 in controlling compact fluorescent lamps (CFLs). A locator light switch 295 may allow a user to turn on or off a locator light for illuminating the pivotable toggle actuator 400 as described below.

Figure 5:
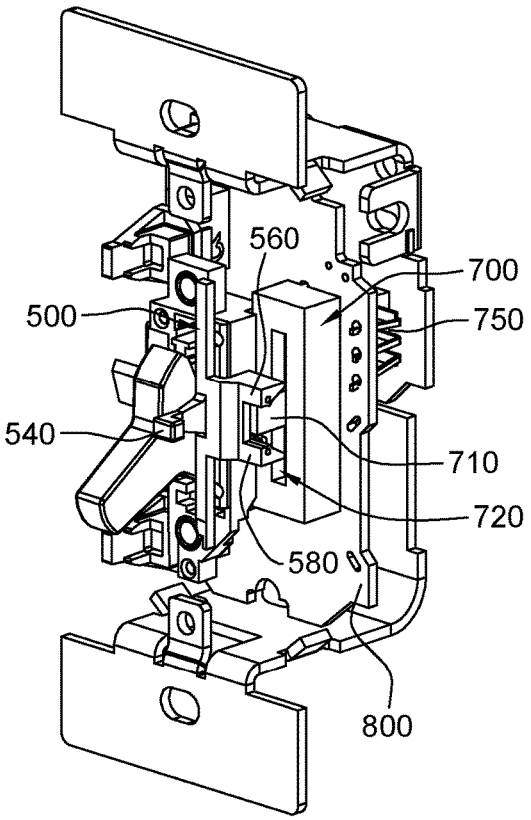

As shown in FIG. 5, slidable dimmer actuator 500 is operable to engage an electronic device 700 disposed in the housing for adjustably controlling a level of power to the load. For example, slidable dimmer actuator 500 may include a pair of legs 560 and 580 that move linearly as handle 540 is moved between positions. In the present example, controllably conductive device 700 may be a potentiometer for adjustably controlling a level of power to the load. Potentiometer 700 may be provided with a sliding tab 710, which slides back and forth along a linear sliding track 720, wherein movement of tab 710 causes power delivered to be varied. When sliding tab 710 is positioned at one end of the sliding track 720, the power delivered to an electrical load being controlled by dimmer switch 100 may be at a minimum setting and when sliding tab 710 is positioned at the other end of sliding track 720, the power delivered to the electrical load being controlled by the dimmer switch 100 may be at a maximum setting. The minimum and maximum settings can be adjusted as described further below. When sliding tab 710 is moved along sliding track 720, the power delivered to the controllably conductive device being controlled may be gradually increased or decreased, depending on the direction that sliding tab 720 is moved.

With reference again to FIGS. 4 and 5, switching device 600 and potentiometer 700 may be operably coupled to a printed circuit board (PCB) 800 disposed in the housing. In this illustrated embodiment, slidable dimmer actuator 500 and sliding tab 710 of potentiometer 700 are slidable along planes parallel to front plate 230 of housing 200. In other embodiments, a tab of a potentiometer may be disposed perpendicular to front plate and movable in a plane perpendicular to the front plate. It should be noted that the dimmer switch may be assembled in any of a number of suitable manners not limited to the structure described herein. Potentiometer 700 may be operably connected via printed circuit board (PCB) 800 to a TRIAC 750 (FIG. 5).

Adjustment of potentiometer 700 operably adjusts the firing point of TRIAC 750 in order to control the power to the load as is known in the art. In other embodiments, a potentiometer may be an input to a microprocessor, which controls a TRIAC.

Figure 6:
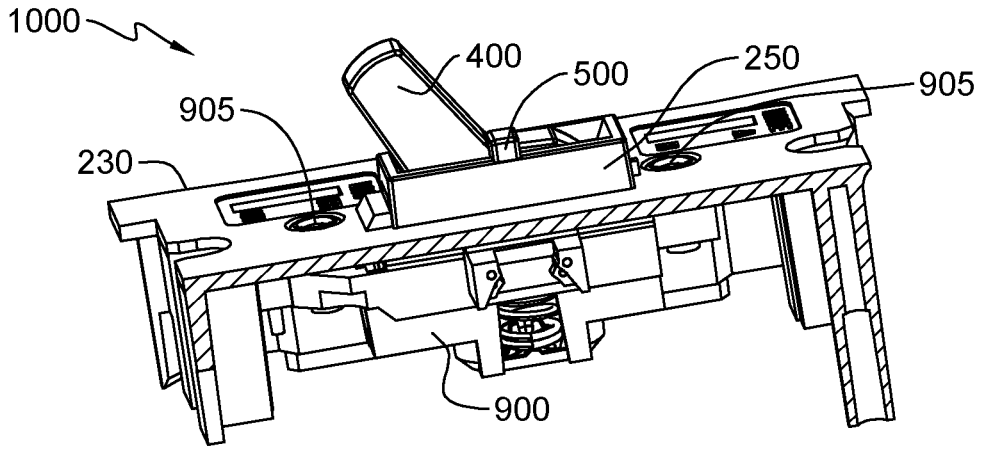
FIG. 6 is a perspective cross-sectional view taken along line 6-6 of the assembly for controlling electrical power to a load from an electrical power source of the dimmer switch of FIG. 2.
Figure 7:
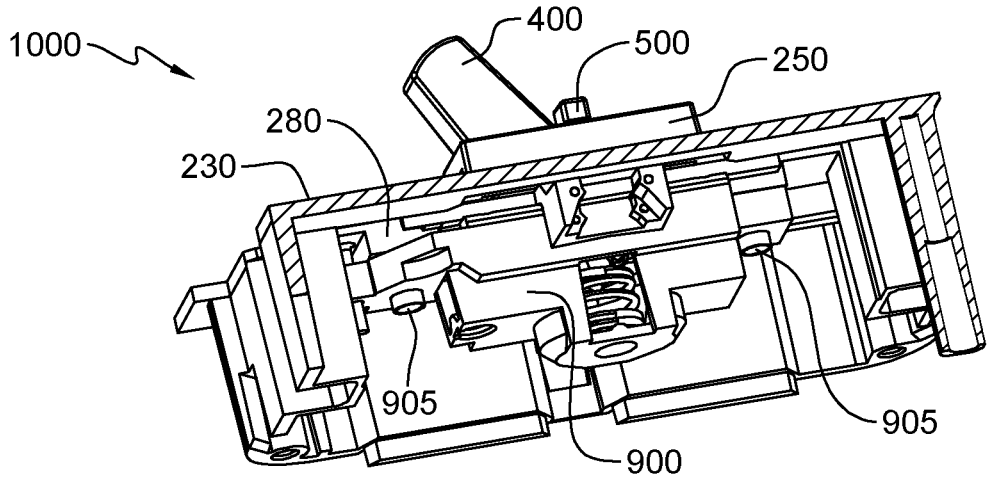
FIG. 7 is another perspective cross-sectional view taken along line 7-7 of the assembly for controlling electrical power to a load from an electrical power source of the dimmer switch of FIG. 2.

FIGS. 6 and 7 illustrate portions of dimmer switch 100 (FIGS. 1 and 2) that form a user actuatable assembly 1000 for use in controlling electrical power to a load from an electrical power source. For example, actuatable assembly 1000 may generally include pivotable toggle actuator 400, slidable dimmer actuator 500, a support 900, and front plate 230 having frame 250.

Figure 8:
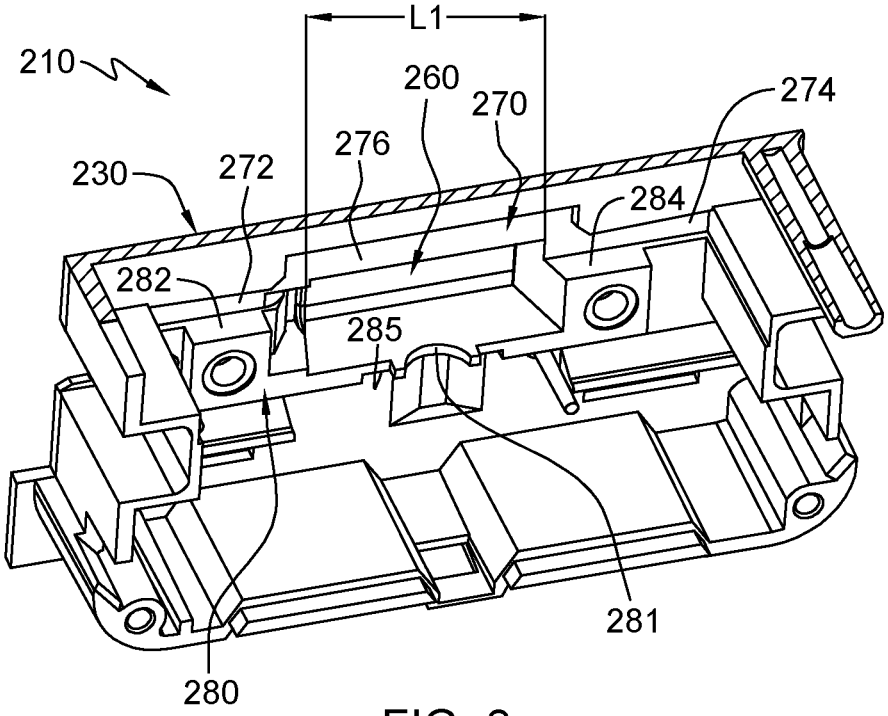
FIG. 8 is a perspective cross-sectional view taken along line 8-8 of the front housing of the dimmer switch of FIG. 2.

As shown in FIG. 8, the inside of front plate 230 may include an elongated channel/recess 270 disposed on one side of passageway 260 and single actuator opening 262 for use in slidably mounting/restraining slidable dimmer actuator 500 (as best shown in FIG. 7). A land 280 may extend around the ends and the other side of passageway 260 and single actuator opening 262. An arcuate guide 281 is disposed in land 280 for use in rotatably mounting/restraining pivotable toggle actuator 400 as described further below.

With reference again to FIGS. 6 and 7, support 900 is coupled to the land 280 (FIG. 8) of front plate 230 by fasteners 905. Fastener 905 may be a temporary fastener, such as a screw or a permanent fastener, such as an eyelet or grommet.

Figure 9:
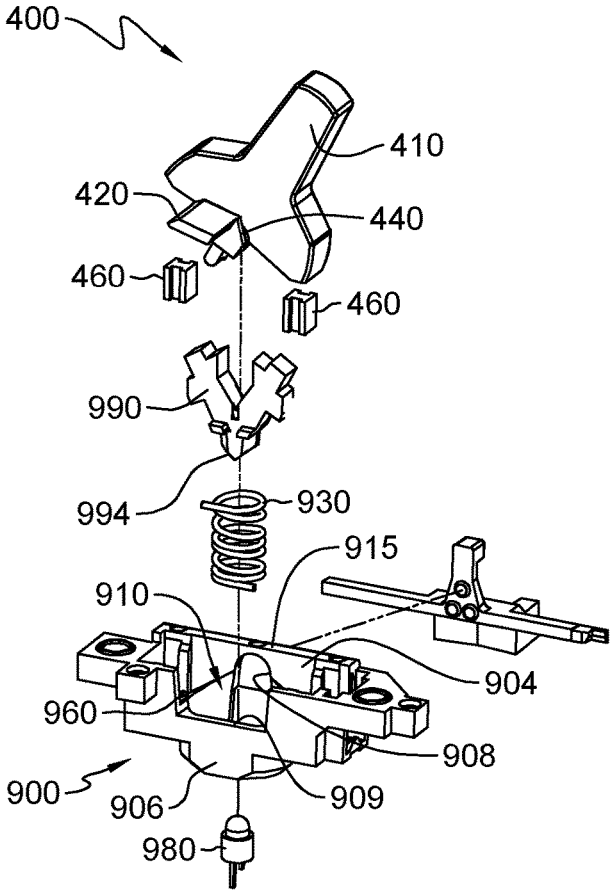
FIGS. 9 and 10 are enlarged, exploded perspective views of portions of the assembly of FIGS. 6 and 7.
Figure 10:
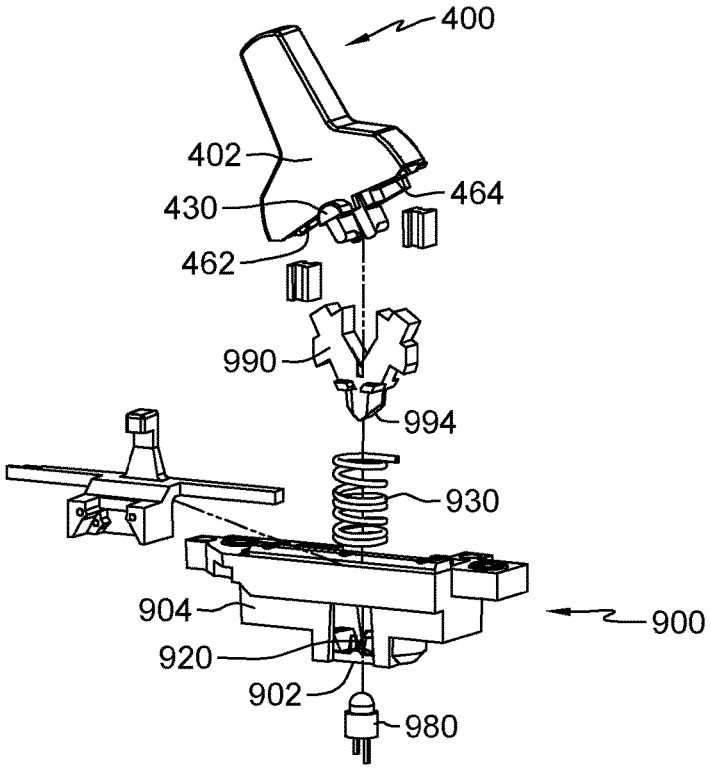

As shown in FIGS. 9 and 10, support 900 may include a bottom wall 902 (FIG. 10) and sidewalls 904 and 906 (FIG. 9), which define a cavity 910 (FIG. 9) for receiving a portion of pivotable toggle actuator 400. End portions of support 900 include apertures 905 (FIGS. 6 and 7) for receiving fasteners. The inside of bottom wall 902 (FIG. 10) includes a protrusion 920 (FIG. 10) for receiving and restraining an end of a metal spring 930 such as a coil or compression spring. A light guide 990 receivable in pivotable toggle actuator 400 includes a protrusion 994 for receiving and restraining the other end of metal spring 930.

With reference to the embodiment of FIG. 9, an interior of sidewall 904 of support 900 may include a recess 907 having a curved surface 908. Sidewall 906 may include a cutout 909. Pivotable toggle actuator 400 includes a semi-circular projection 430 (FIG. 10) extending from one side of pivotable toggle actuator 400, and a recessed semi-circular projection 440 (FIG. 9) extending from the other side of pivotable toggle actuator 400 adjacent leg 420 (FIG. 9). When assembly 1000 (FIGS. 6 and 7) is assembled, pivotable toggle actuator 400 is rotatably restrained. For example, pivotable toggle actuator 400 is biased by spring 930 so that semi-circular projection 430 (FIG. 9) is rotatably restrained in recess 907 (FIG. 9), semi-circular projection 440 (FIG. 9) is restrained in arcuate guide 281 (FIG. 8), and arm 420 is free to extend through cutout 909 in sidewall 906. Spring 930 provides a force to the protrusion 940 (FIG. 10) of pivotable toggle actuator 400, causing lever 410 to spring into its first or second position when a mild force is applied to lever 410 in a direction that corresponds to the respective position. Rubber feet 460 may be mounted in cutouts 462 and 464 (FIG. 10) in opposing ends of pivotable toggle actuator 400. Ends of rubber feet 460 are operable for cushioning as they land on stops 960 (only one of which is shown in FIG. 9) of support 900 due to the spring action of pivotable toggle actuator 400 caused by spring 930 and cooperating projection 940 (FIG. 10).

Figure 11:
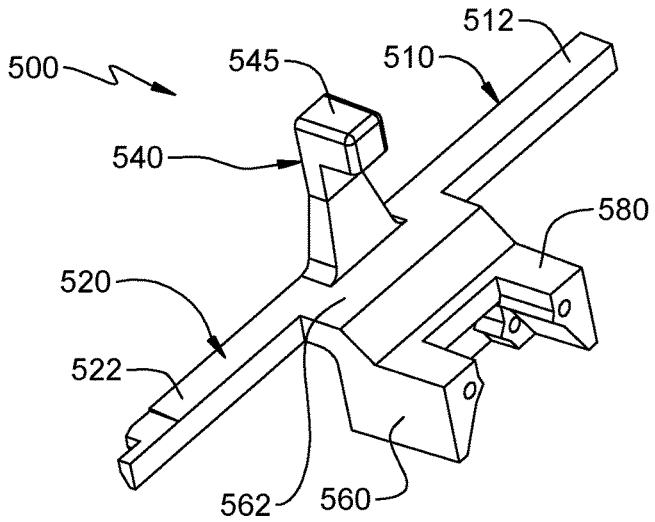
FIG. 11 is an enlarged, top perspective view of the slidable dimmer actuator of the switch assembly of FIGS. 9 and 10.

As shown in FIG. 11, slidable dimmer actuator 500 may be a monolithic component formed of a single piece of non-conductive material such as plastic. In other embodiments, a slidable dimmer actuator may be assembled from two or more parts. Slidable dimmer actuator 500 may generally include aligned, outwardly-extending guides 510 and 520, transversely and forwardly extending handle 540, and transversely and rearwardly extending legs 560 and 580. Handle 540 may have an outwardly-extending tab 545.

Guides 510 and 520 may have a square cross-section and include forward facing surfaces 512 and 522. Upper portions of legs 560 and 580 may define forward facing surfaces 562. With reference again to FIG. 8, elongated recess 270 may include aligned first portion 272 and second portion 274. A middle portion 276 may be disposed and offset from aligned portions 272 and 274. With reference again to FIG. 7, when assembly 1000 is assembled, slidable dimmer actuator 500 is slidably restrained between the inside surface of front plate 230 and support 900. For example, guides 510 and 520 of slidable dimmer actuator 500 (FIG. 11) are slidably restrained in the space formed by aligned portions 272 and 274 (FIG. 8) of elongated recess 270 (FIG. 8) and surface 915 (FIG. 9) of support 900 (FIG. 9). Forward facing surfaces 562 and 582 (FIG. 11) of upper portions of legs 560 and 580 (FIG. 11) are slidably restrained in the space formed by middle portion 276 (FIG. 8) of elongated recess 270 (FIG. 8) and surface 915 (FIG. 9) of support 900 (FIG. 9).

Figure 12:
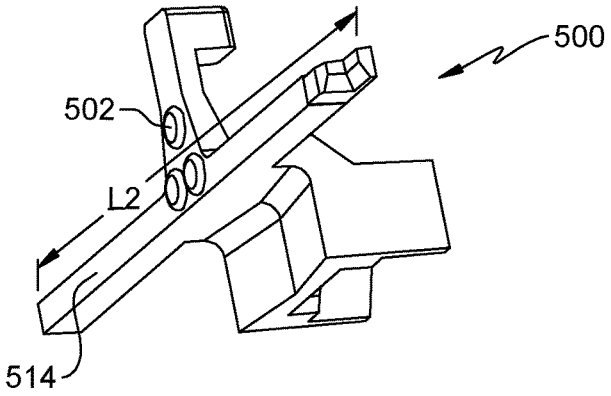
FIG. 12 is an enlarged bottom perspective view of the slidable dimmer actuator of the switch assembly of FIGS. 9 and 10.

With reference to FIGS. 8 and 12, when assembly 1000 (FIGS. 6 and 7) is assembled, in one embodiment slidable dimmer actuator 500 may include a plurality of protrusions 502 disposed on a side surface 514 (FIG. 12) so that protrusions 502 slidably engage side surface 402 (FIG. 10) of pivotable toggle actuator 400 (FIG. 10). Protrusions 502 may extend a distance of about 0.2 millimeter to about 0.4 millimeter, or about 0.3 millimeter from side surface 514 (FIG. 12). Due to protrusions 502 engaging side surface 402 (FIG. 10) of pivotable toggle actuator 400 (FIG. 10), side surface 514 (FIG. 12) of slidable dimmer actuator 500 (FIG. 12) is normally spaced from side surfaces 282 and 284 (FIG. 8) of land 280 (FIG. 8) of front housing portion 210. In the event that a user applies too great a force on the slidable dimmer actuator toward the pivotable toggle actuator when operating slidable dimmer actuator 500, side surface 514 (FIG. 12) and side surfaces 282 and 284 (FIG. 8) engage each other and restrain and inhibit slidable dimmer actuator 500 from movement toward the middle of passageway 260 (FIG. 8) and single actuator opening 262 (FIG. 8).

Figure 13:
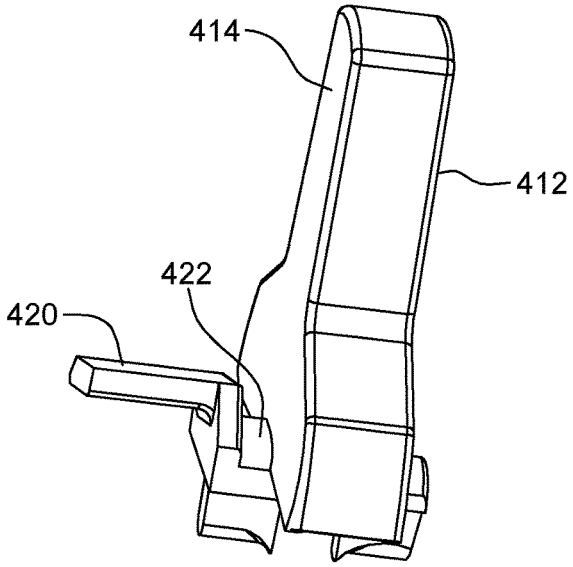
FIG. 13 is an enlarged perspective view of the pivotable toggle actuator of FIGS. 9 and 10.
Figure 14:
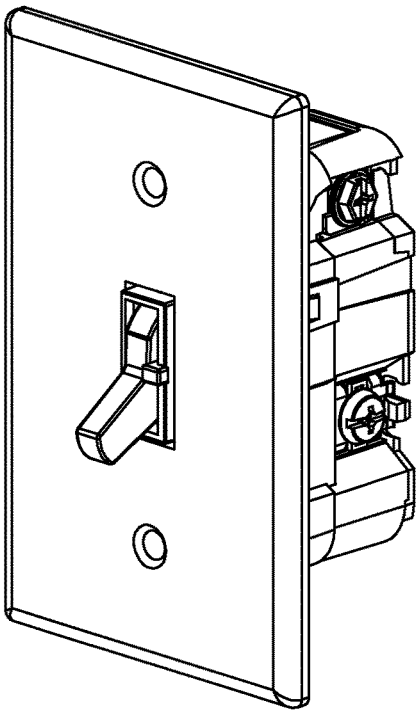
FIGS. 14-19 are a perspective, front elevational, right side elevational, left side elevational, top, and bottom views of a dimmer switch according to an embodiment of the present disclosure along with a wall switch plate.
Figure 15:
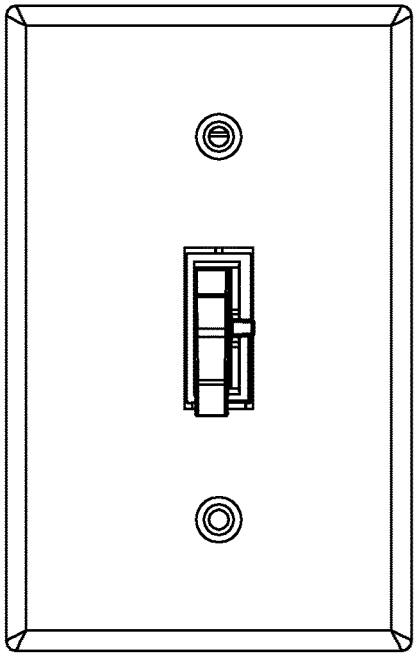
Figure 16:
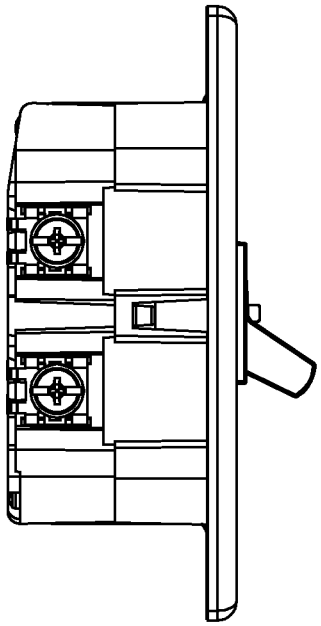
Figure 17:
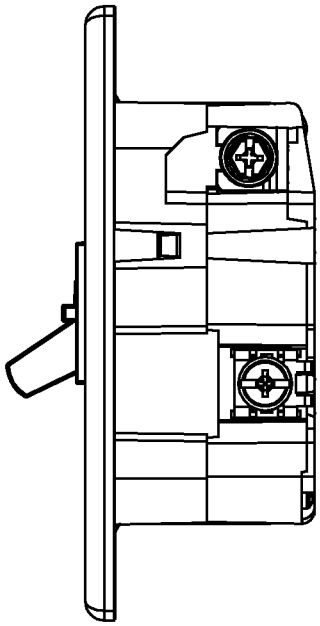
Figure 18:
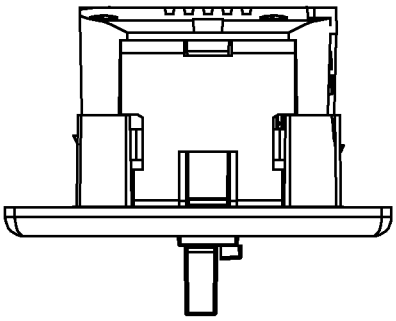
Figure 19:
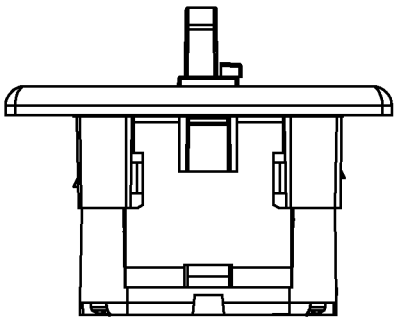

With reference to FIGS. 8 and 13, also when assembly 1000 (FIGS. 6 and 7) is assembled, arm 420 (FIG. 13) of pivotable toggle actuator 400 (FIG. 13) includes a side surface 422 (FIG. 13) that is disposed against side surface 285 (FIG. 8) of land 280 (FIG. 8). Side surface 422 (FIG. 13) and side surfaces 285 (FIG. 8) may restrain and inhibit pivotable toggle actuator 400 from movement toward the middle of passageway 260 (FIG. 8) and single actuator opening 262 (FIG. 8).

As will be appreciated, the positioning of side surfaces 282 and 284 (FIG. 8), the positioning of side surface 285 (FIG. 8) of land 280 along with side surface 422 (FIG. 13) and an opposite side 412 (FIG. 12) of pivotable toggle actuator 400, and protrusions 502 (FIG. 12), each may be sized and configured so that opposing side surfaces of pivotable toggle actuator 400 and slidable dimmer actuator 500 are generally spaced from each other. For example, protrusions 502 (FIG. 12) may generally provide a clearance C (FIG. 2) as slidable dimmer actuator 500 (FIG. 1) is moved between the first and second positions. Slidable dimmer actuator 500 (FIG. 12) may have a length spanning a distance L2 (FIG. 12) which is greater than a distance L1 (FIG. 8) across which slidable dimmer actuator 500 is movable along passageway 260 (FIG. 8) and single actuator opening 262 (FIG. 8).

With reference to FIGS. 9 and 10, assembly 1000 (FIGS. 6 and 7) may include a light source 980 such as an LED or neon bulb supported in support 900. Light guide 990 may be restrained in pivotable toggle actuator 400. The light produced by light source 980 is directed into a lower end of translucent member 990 and out an upper end to provide a backlighting effect inside pivotable toggle actuator 400 so that a translucent pivotable toggle actuator 400 may be illuminated and visible to a user in wall switch plate 10 (FIG. 1). When the LED or neon light is on it provides a gentle glow that can help a user locate pivotable toggle actuator 400 of the dimmer switch 100 (FIG. 1) in a dark room. As noted above, use of light source 980 may be turned on or off by a user via locator switch 295 (FIG. 2). Features of further electrical load control devices with a light indicator as disclosed in U.S. Patent Application Ser. No. 62/416,597, entitled "Actuator Alternating Indicator Light," by Ronald Jansen, Alfred Lombardi, and Adam Kevelos, the entire subject matter of this application being incorporated herein by reference, may be operably incorporated into a toggle dimmer switch according to the present disclosure.

FIGS. 14-19 are a perspective, front elevational, right side elevational, left side elevational, top, and bottom views of a dimmer switch according to an embodiment of the present disclosure along with a wall switch plate.

In some embodiments, a dimmer switch according to the present disclosure may include a potentiometer setting control (PSC) which allows a user to set the minimum or maximum power level setting controlled by the slidable dimmer actuator. For example, the PSC may be operable to set a minimum power level setting for the potentiometer/dimmer, a maximum power level setting for the potentiometer/dimmer, or a minimum power level setting for the potentiometer/dimmer and a maximum power level setting that the potentiometer/dimmer. The PSC may be accessible by a user from the front plate of the housing such as through an aperture in the front plate either toolessly or using a tool such as a screwdriver. The aperture is normally covered by a wall switch plate. It should be noted that while the embodiment described includes a PSC for setting a minimum or maximum power level, any suitable adjustable element can be used to set any suitable characteristic desired to be set.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of one or more aspects of the disclosure and the practical application, and to enable others of ordinary skill in the art to understand one or more aspects of the disclosure for various embodiments with various modifications as are suited to the particular use contemplated. The corresponding structures, materials, acts, and equivalents of all means or step plus function elements in the claims below, if any, are intended to include any structure, material, or act for performing the function in combination with other claimed elements as specifically claimed.

The invention claimed is:

1. An assembly for use in controlling electrical power to a load from an electrical power source, said assembly comprising:

a frame having a single actuator opening therethrough, said single actuator opening having first and second portions;

a support operably attachable to said frame;

a pivotable toggle actuator accessible through said first portion of said single actuator opening, said toggle actuator pivotable between a first position and a second position by a user;

a slidable dimmer actuator accessible through said second portion of said single actuator opening, said slidable dimmer actuator being slidable linearly within said second portion of said single actuator opening anywhere between a first position and a second position by a user; and wherein said pivotable toggle actuator is operable for controlling a controllably conductive device to turn on and off power to the load, and said slidable dimmer actuator is operable for controlling said controllably conductive device to adjustably control the level of power to the load.

2. The assembly of claim 1 wherein said frame receivable in an opening of a wall switch plate.

3. The assembly of claim 1 wherein no visible material is disposed between said pivotable toggle actuator and said slidable dimmer actuator within said single actuator opening.

4. The assembly of claim 1 wherein said pivotable toggle actuator includes a recessed semi-circular projection, and said housing includes an arcuate guide disposed adjacent said single actuator opening, said arcuate guide being configured to pivotally receive said recessed semi-circular projection.

5. The assembly of claim 1 wherein said pivotable toggle actuator is configured to pivot from a first side to a second side of said single actuator opening, said slidable dimmer actuator includes a handle, and said handle is slidable from said first side to said second side of said single actuator opening.

6. The assembly of claim 1 wherein said slidable dimmer actuator includes an elongated guide slidably restrained below said frame.

7. The assembly of claim 6 wherein said elongated guide has a length that is greater than a length of said single actuator opening.

8. The assembly of claim 1 wherein said slidable dimmer actuator comprises a handle, a plurality of laterally extending guides, and a plurality of downwardly depending legs.

9. The assembly of claim 8 wherein said slidable dimmer actuator further comprises a plurality of protrusions slidably engagable with a side of said pivotable toggle actuator.

10. A dimmer switch for use in controlling electrical power to a load from an electrical power source, said dimmer switch comprising:

a housing having a frame, said frame having a single actuator opening therethrough, said single actuator opening having first and second portions;

a controllably conductive device disposed in said housing for adjustably controlling electrical power to the load;

a pivotable toggle actuator accessible through said first portion of said single actuator opening, said toggle actuator pivotable between a first position and a second position by a user;

a slidable dimmer actuator accessible through said second portion of said single actuator opening, said slidable dimmer actuator being slidable linearly within said second portion of said single actuator opening anywhere between a first position and a second position by a user; and wherein said pivotable toggle actuator is operable for controlling said controllably conductive device to turn on and off power to the load, and said slidable dimmer actuator is operable for controlling said controllably conductive device to adjustably control the level of power to the load.

11. The dimmer switch of claim 10 wherein said frame being receivable in an opening of a wall switch plate and said housing receivable in an electrical wall box.

12. The dimmer switch of claim 10 wherein no visible material is disposed between said pivotable toggle actuator and said slidable dimmer actuator within said single actuator opening.

13. The dimmer switch of claim 10 wherein said frame is a continuous frame and said single actuator opening is a continuous opening.

14. The dimmer switch of claim 10 wherein said controllably conductive device comprises a microswitch, and said pivotable toggle actuator actuates said microswitch.

15. The dimmer switch of claim 10 wherein said controllably conductive device comprises a potentiometer, and said slidable dimmer actuator actuates said potentiometer.

16. The dimmer switch of claim 10 wherein said pivotable toggle actuator includes a recessed semi-circular projection, and said housing includes an arcuate guide disposed adjacent said single actuator opening, said arcuate guide being configured to pivotally receive said recessed semi-circular projection.

17. The dimmer switch of claim 10 wherein said housing comprises an upper body portion, a lower body portion, wherein said upper body portion includes said frame.

18. The dimmer switch of claim 10 further comprising at least one circuit board, wherein said controllably conductive device is arranged in electrical communication with said circuit board.

19. The dimmer switch of claim 10 wherein said pivotable toggle actuator is configured to pivot from a first side to a second side of said single actuator opening, said slidable dimmer actuator includes a handle, and said handle is slidable from said first side to said second side of said single actuator opening.

20. The dimmer switch of claim 10 wherein said slidable dimmer actuator includes an elongated guide, said housing includes an elongated recess disposed adjacent said single actuator opening, said elongated recess being configured to slidably receive said elongated guide.

21. The dimmer switch of claim 20 wherein said elongated guide has a length that is greater than a length of said single actuator opening.

22. The dimmer switch of claim 10 wherein said slidable dimmer actuator comprises a handle, a plurality of laterally extending guides, and a plurality of downwardly depending legs.

23. The dimmer switch of claim 22 wherein said slidable dimmer actuator further comprises a plurality of protrusions slidably engagable with a side of said pivotable toggle actuator.

* * * * *